United States Patent [19]

Schreder

[11] Patent Number: 4,723,067

[45] Date of Patent: Feb. 2, 1988

[54] ELECTRIC HOTPLATE

[75] Inventor: Felix Schreder, Oberderdingen, Fed. Rep. of Germany

[73] Assignee: E.G.O. Elektro-Geräte Blanc U. Fischer, Fed. Rep. of Germany

[21] Appl. No.: 48,770

[22] Filed: May 12, 1987

[30] Foreign Application Priority Data

May 27, 1986 [DE] Fed. Rep. of Germany ..... 3617742

[51] Int. Cl.[4] ..... H05B 3/70

[52] U.S. Cl. ..... 219/450; 219/512; 219/449; 219/459

[58] Field of Search ..... 219/450, 443, 448, 449, 219/451, 452, 457, 458, 459, 460, 461, 462, 464, 512; 337/390, 391, 394

[56] References Cited

U.S. PATENT DOCUMENTS

| | | | |
|---|---|---|---|
| 2,148,407 | 2/1939 | Pierson | 219/449 |
| 2,311,087 | 2/1943 | Sandell | 219/449 |
| 4,122,330 | 10/1978 | Fischer | 219/512 |
| 4,135,081 | 1/1979 | Fischer | 219/512 |
| 4,393,299 | 7/1983 | McWilliams | 219/468 |
| 4,605,841 | 8/1986 | Fischer | 219/452 |

FOREIGN PATENT DOCUMENTS

| | | |
|---|---|---|
| 0079483 | 5/1983 | European Pat. Off. . |
| 1120099 | 12/1961 | Fed. Rep. of Germany . |
| 1127007 | 4/1962 | Fed. Rep. of Germany . |
| 2415712 | 4/1977 | Fed. Rep. of Germany . |
| 2627373 | 12/1977 | Fed. Rep. of Germany . |
| 2459649 | 10/1979 | Fed. Rep. of Germany . |
| 3027998 | 2/1982 | Fed. Rep. of Germany . |
| 3131462 | 2/1983 | Fed. Rep. of Germany . |
| 1212941 | 11/1970 | United Kingdom . |

*Primary Examiner*—Clifford C. Shaw
*Assistant Examiner*—Teresa J. Walberg
*Attorney, Agent, or Firm*—Steele, Gould & Fried

[57] ABSTRACT

An electric hotplate (1) with a temperature sensor (21) of a power control device provided in the center of the cooking surface (3) has on the underside of area (5) of hotplate body (2) directly heated by heating resistors (7, 8) a thermal cutout (27) with rod-like temperature sensors (28) projecting freely from a switch casing (29). Switch casing (29) is located outside a cover (17) of underside (4) of hotplate body (2) and temperature sensor (28) is located within said cover. In the case of high switching precision of thermal cutout (27), the limiter switch is still not damaged if the thermal cutout is set to relatively high cut-off temperatures.

25 Claims, 4 Drawing Figures

ELECTRIC HOTPLATE

Figure 1:
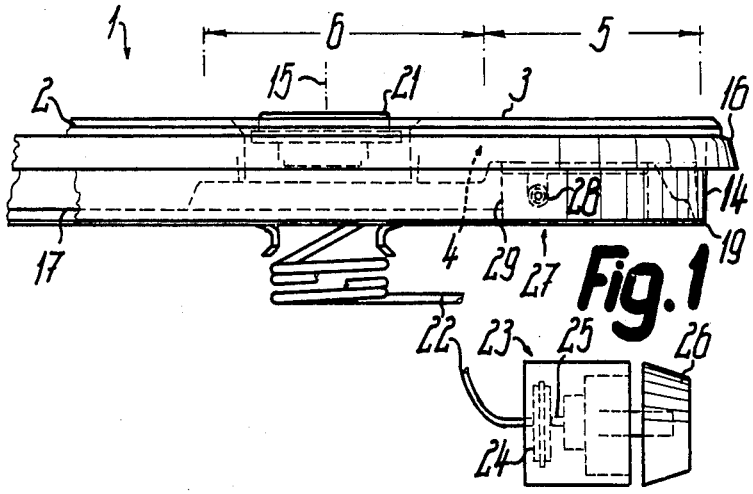

The invention relates to an electric hotplate with a hotplate body provided around a central zone on its underside remote from the cooking surface with at least one heating resistor and having at least one thermal cutout located with a switch casing receiving a limiter switch in the heated region on the underside of the hotplate body and having a temperature sensor.

Attempts have already been made to place thermal cutouts as temperature limiting means directly on the underside of the heated region of the hotplate body, particularly it can be difficult to find space for the same in view of the restricted spatial conditions, especially with small hotplates. Good results were also obtained in connection with the operation of the thermal cutout. However, it has been found that particularly with powerful electric hotplates, such as are e.g. frequently formed by so-called automatic electric hotplates, when the cutout or limiter switch usually formed by a snap switch is positioned too close to the heated area or in the case of heating resistors, difficulties can occur with regards to the thermal loading of the switch and consequently regarding the function thereof. Particularly as a result of surge-like high heating of the limiter switch there can be changes in the generally present switch springs as regards to the spring characteristics thereof, which leads to a misadjustment of the switch.

The problem of the present invention is to provide an electric hotplate of the aforementioned type, in which on the one hand a space-saving arrangement of the thermal cutout is achieved in the case of simple construction and on the other a particularly precise switching function of said thermal cutout is ensured under all the thermal stresses or loads which occur.

According to the invention this problem is solved by an electric hotplate of the aforementioned type, in which the temperature sensor is constructed as an expansion rod sensor exposed outside the switch casing, which is located completely outside the generally unheated central zone and is spaced parallel with respect to the underside of the hotplate body. Although such a thermal cutout having a temperature sensor in the form of an outer tube and an inner rod located therein with different specific thermal expansion coefficients generally has as a limiter switch a snap switch, the latter for providing protection against thermal stresses can be located in a more favourable position with respect to the heated region of the hotplate compared with a snap switch controlled by a bimetal element, because the relatively long rod sensor giving high actuating forces in the case of thermal loading can extend a relatively long way from the switch casing. Thus, the switch casing need not be positioned in the relatively confined area of the unheated central zone, so that there is space there for at least one further temperature sensor, assembly parts of the electric hotplate or other components. As a result of the inventive construction the temperature sensor can assume a position in which from its end entering the switch casing to its free end it is exposed in uniterrupted uniform manner to the heated area on the underside of the hotplate body.

It is admittedly conceivable to position the expansion rod thermal cutout in concealed manner within the electric hotplate unit, but in this case costly and complicated measures would be necessary for ventilating the switch casing when using powerful electric hotplates.

According to another feature of the invention, this can be avoided in surprisingly simple manner, in that in an electric hotplate, whose underside is at least partly provided with a cover, the switch casing is located partly outside and the temperature sensor substantially inside the cover, i.e. within the space surrounded by the cover and the underside of the hotplate body, so that the switch casing is exposed to effective air cooling, whilst the temperature sensor is protected against ventilation.

Appropriately the switch casing is located completely outside the cover. In the vicinity of the switch casing, the cover could have at least one e.g. window-like opening, but the switch casing can be particularly well shielded against the heat irradiated from the underside of the hotplate body if, between the switch casing and the underside of said hotplate body is provided a substantially completely closed wall portion of the cover. This wall portion, with which the associated side of the switch casing engages with substantially its whole area, is generally made, like the cover, from sheet steel, so that the heat supplied by heat conduction to the intermediate wall portion is removed therefrom substantially over the entire cover, particularly if the latter is spaced from the heated region of the underside of the hotplate body, as well as in the vicinity of the intermediate wall portion, and is consequently cooler. The switch casing is e.g. made from a ceramic insulating material, particularly steatite.

The inventive construction even makes it possible to support the switch casing at least approximately against the underside of the hotplate body, particularly against an insulating material embedding the heating resistor, which leads to a space-saving construction, without the risk of the function of the limiter switch being impaired. In order that the switch casing, e.g. through a window opening in the cover, does not have to be directly supported on said underside, on the underside of the cover is provided a recess receiving the switch casing and its planar base wall engages approximately on said underside of the hotplate body. Thus, the switch casing only projects over the underside of the hotplate body by its own height and by the thickness of said base wall.

So that the temperature sensor is as tight as possible with respect to air flows and can be brought as close as possible to the switch casing on the inside of the cover, the temperature sensor is placed through a port in the cover, which is adapted as closely as possible to the outer circumference of the temperature sensor, but is wide enough to easily permit the fitting of the thermal cutout.

The lead connecting the thermal cutout with the heating resistors is appropriately also guided through a port on the inside of the cover, so that the connecting lugs of the switch casing are positioned outside the space cover by the cover. Thus, although the switch casing is located on the outside or underside of the cover, the arrangement can consequently be such that the exposed or bare and uninsulated portions of the leads connected to the switch casing are extremely short and only from a correspondingly short bridge between the switch casing and an insulator made from ceramics, such as steatite inserted in the port.

A particularly advantageous further development of the invention comprises the thermal cutout being secured by at least one plug-in mount on the hotplate, particularly exclusively on the cover, so that there is no need for separate fixing or tensioning means for securing the switch casing. The thermal cutout or switch casing can in simple manner be suspended between the temperature sensor port and the insulator port on two remote sides, so that no fastening means engage on the switch casing and instead engage through the resilient suspension with limited contact pressure on the underside of the associated wall portion of the cover. The portions of the leads located between the switch casing and the insulator as a result of a corresponding shaping can be used for said resilient engagement and for a certain damping of the suspension of the thermal cutout.

For an even better, space-saving housing of the thermal cutout, the central axis of the temperature sensor is approximately tangentially to an imaginary circle placed round the central axis of the hotplate body, the switch casing being locatable with the centre of its width to be measured in the longitudinal direction of the temperature sensor in the vicinity of the axial plane of the hotplate body at right angles to the central axis of the temperature sensor, which substantially then also applies for the reception depression in the cover, so that the edge walls tranversed by the temperature sensor and the leads are provided parallel to said axis plane and at right angles to the temperature sensor.

In order to provide an optimum dimensionally stable construction of the area of the cover in which is located the thermal cutout which is completely contact-free with respect to the hotplate body, even in the case of a very thin-walled construction of the cover, the latter, based on the central axis of the hotplate body, is positioned immediately adjacent to the radially inner and also immediately adjacent to the radially outer side of the reception depression or the switch casing on at least one ring flange projecting over the underside of the hotplate body and in one piece therewith, so that in this area there are relatively significantly varying profilings of the cover.

On one side, which simultaneously serves for the fitting by insertion of the switch parts located therein, the switch casing can be open over its entire inner width and the switch casing with the edge face of said open side, with respect to which the switch parts and associated temperature sensor end are set back, faces the underside of the hotplate body or is supported on said underside or on the associated wall portion of the cover. On the edge face can be provided stud-like-projecting spacers, so that there is a gap portion between the remaining edge face and the associated bearing face of the electric hotplate, which permits ventilation of the interior of the switch casing. Apart from the thus arranged and constructed casing body, the switch casing can have an in particular flat or plate-like, planar casing lid closing same on the open side and which forms an integrated component with the switch casing. The thermal cutout can be essentially constructed as described in W. German Examined Application No. 2422625, to which reference should be made for further details.

The inventive construction is particularly suitable for those electric hotplates, in which on the hotplate body and in particular in the vicinity of its underside, is provided a further temperature sensor of a power control device and which are therefore at least briefly suitable for relatively high thermal loading. It has been found that during the operation of the electric hotplate, there are temperature differences of approximately 140° C. between the temperature sensor and the switch casing and that consequently the thermal cutout can be set to a much higher cut-off temperature, without any risk of switch parts being damaged at such high limit temperatures. If, in the manner of an automatic hotplate, the hotplate body has in an opening provided in its centre the last-mentioned, further temperature sensor in the form of a sensing capsule engaging directly on the underside of the cooking vessel, then through the inventive construction of said further temperature sensor and the actual thermal cutout do not impede one another, even in the case of relatively small diameter hotplates and instead there is a good and complete spatial separation. Whereas the further temperature sensor takes the temperature immediately on the cooking vessel, the temperature sensor of the thermal cutout takes the temperature immediately from the bottom of the heated zone of the hotplate body.

These and further features of the preferred further developments of the invention can be gathered from the description and drawings and the individual features, either singly or in the form of subcombinations can be realized in an embodiment of the invention and in other fields. An embodiment of the invention is described in greater detail hereinafter relative to the drawings, wherein show:

FIG. 1 A detail of an inventive electric hotplate in side view.

Figure 2:
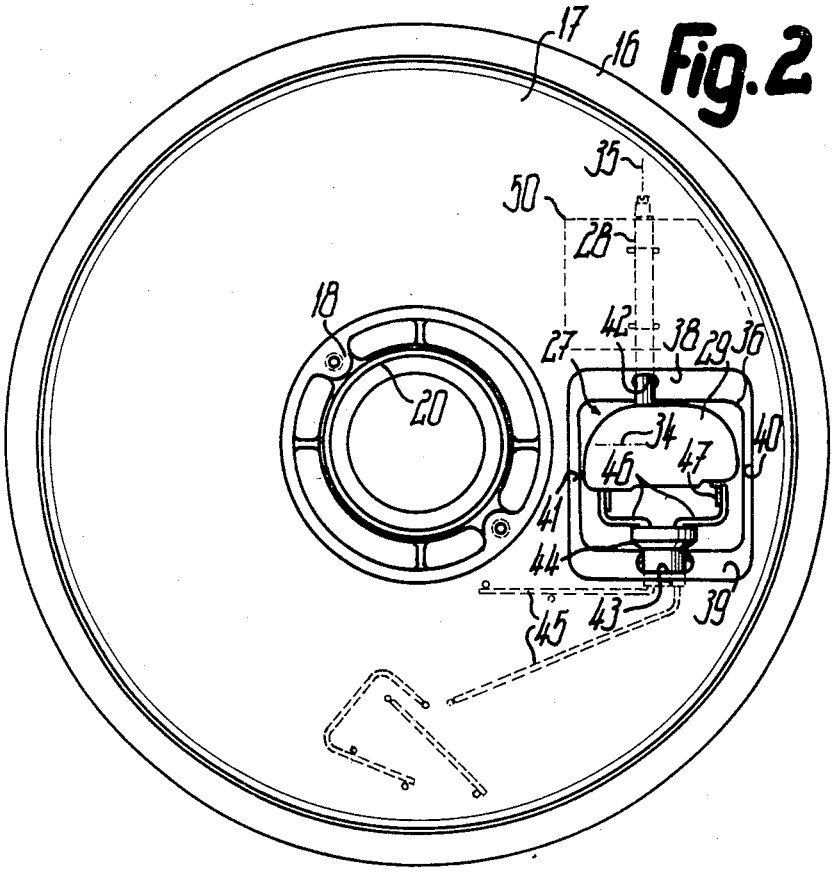

FIG. 2 The electric hotplate according to FIG. 1 in a view from below.

Figure 3:
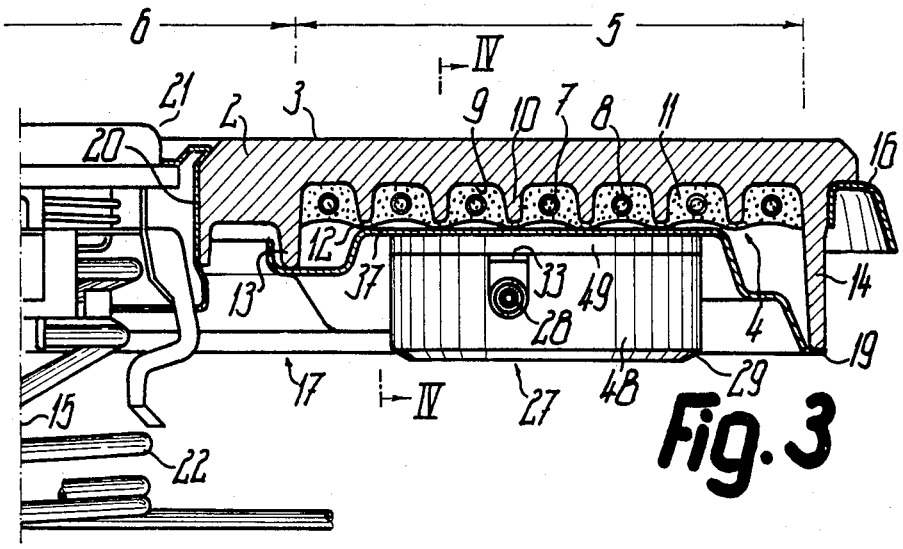

FIG. 3 A detail of the electric hotplate according to FIG. 1 on a larger scale and in axial section.

Figure 4:
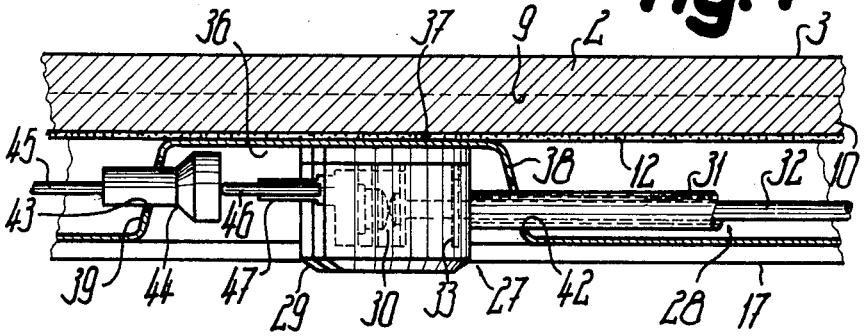

FIG. 4 A section along line IV—IV of FIG. 3.

As shown in FIGS. 1 to 4, an inventive electric hotplate 1 has a circular or annular, solid hotplate body made from cast material 2, whose annular, planar top surface forms a cooking surface 3 and in whose underside 4 are provided at least one heating resistor and in particular at least two heating resistors 7, 8 in such a way that the hotplate body 2 forms an annular, heated area 5 essentially connected to its outer circumference and in the centre a not directly heated zone 6 defined with respect thereto. Heating resistors 7, 8 located in a common plane in interengaging spirals about the central axis 15 of hotplate body 2 are positioned in corresponding spiral grooves 9 in an area of the underside 4 of hotplate body 2 closest to cooking surface 3 and adjacent spiral grooves 9 are separated from one another by relatively thin spiral webs 10. With respect to the hotplate body 2, the heating resistors 7, 8 are embedded in an insulating material 11 in contact-free manner relative to hotplate body 2 and said insulating material covers with a thin layer 12 the lower terminal edges of spiral webs 11 and in the area between in each case two adjacent spiral webs 10 in cross-section forms a concavely reentrant lower surface which is therefore set back with respect to the terminal edges of the spiral webs 10. The heated area 5 is bounded on the inner circumference by a ring flange 13 of hotplate body 2 projecting further downwards than spiral webs 10 and on the outer circumference by an even further downwardly projecting outer ring flange 14, which is slightly inwardly displaced with respect to the outer circumference of hotplate body 2 connected to cooking surface 3 and carries in a resulting outer ring shoulder a carrier ring 16 for supporting the electric hotplate in the vicinity of a hob opening. The underside 4 of hotplate body 2 is almost completely covered in a ring zone extending from the outer ring flange 14 to the inner ring flange 13 by a lid-like cover 17 made from thin sheet metal engaging substantially in whole area manner on the lower terminal edges of ring flanges 13, 14 and consequently surrounding a corresponding annular space with ring flanges 13, 14 and the underside of hotplate body 2. On the inner circumference of the inner ring flange 13, cover 17 has a collar drawn towards the cooking surface 3 and surrounding a central opening and which is shaped on two diameterically facing points to give radially inwardly projecting fixing pieces 18, fixed against the hotplate body 2 by screws for fixing cover 17 inserted in lug-like attachments of the inner ring flange 13. On the outer circumference cover 17, which need only be supported on the inner circumference of outer ring flange 14, has a flange rim 19 located in one plane and by means of which it engages on ring flange 14.

In an opening 20 centrally traversing the hotplate body 2 within the inner ring flange 13 is so resiliently positioned a temperature sensor 21 of a hydraulic expansion system not shown in FIG. 2, that in the relieved state it projects upwards over cooking surface 3 and is pressed downwards against spring tension by engaging a cooking vessel. This temperature sensor 21 which is stop-limited in its upper end position is connected by means of a capillary tube 22 led away from its underside with the expansion member 24, e.g. formed by a pressure element, of a power control device 23 for controlling the electric hotplate, expansion member 24 acting on a switch 25 of the power control device 23, which can be adjusted by means of a knob 26 arranged on an adjusting spindle to different power ranges of the electric hotplate.

In addition to temperature sensor 21 and completely outside the not directly heated area 6, there is also a thermal cutout 27, in which temperature sensor 28 and the switch casing 29 forming the switch head and including the limiter switch located thereon are constructionally integrated with one another and form a closed constructional unit. The switch casing 29 which, in plan view, is approximately elongated and rectangular and rounded with relatively large radii of curvature in two corner regions has on one longitudinal side adjacent to the associated rounding portion the rod-like, linear temperature sensor 28 projecting approximately at right angles over said longitudinal side and whose length exceeds that of the switch casing. Temperature sensor 28 essentially comprises a metallic outer tube 31 fixed with a flange plate 33 provided on its associated end in a corresponding insertion slot of the switch casing 29, as well as a non-metallic inner rod 32 with a very limited expansion coefficient arranged in said outer tube 31 and whose outer end is adjustably supported on the free end of outer tube 31 and is supported with its inner end, located in switch casing 29, on a pressure point for operating the limiter switch 30. Central axis 35 of temperature sensor 28 is at right angles to an axial plane 34 of central axis 15, which passes approximately through the centre between the longitudinal boundaries of switch casing 29, the free end of temperature sensor 28 extending approximately up to the inner circumference of outer ring flange 14, but is contact-free with respect thereto. Central axis 35 is parallel to cooking surface 3 or to the underside 4 of cooking plate body 2, but substantially over its entire length, the temperature sensor 28 is contact-free with respect to said underside 2 and cover 17 and is located relatively near to a wall portion of cover 17 cross-sectionally parallel thereto.

Over substantially the entire length of the temperature sensor 28, it is located within the area covered by cover 17, whilst the switch casing 29 is located entirely outside this area on the underside of cover 17, namely in a depression 36 formed therein. As the base wall, depression 36 has a planar wall portion 37, on which engages in a substantially whole area manner the top of switch casing 29. To wall portion 37 are connected four rim walls 38 to 41 at right angles to portion 37 and projecting downwards, being located on the longitudinal sides of an imaginary rectangle or square. In the cross-section according to FIGS. 3 and 4, walls 38 and to 41 are inclined downwards and outwards under acute angles and have different heights. The two equally high rim walls 38, 39 projecting approximately at right angles to temperature sensor 28 have the greatest height, whereas rim wall 41 at right angles thereto and closer to central axis 15 has the smallest height, namely only extending from the level of the underside 4 of heated area 5 to the level of the terminal edge of the inner ring flange 13. The facing rim wall 40 has an intermediate height and passes via a shoulder into flange rim 19. The width of wall portion 37 measured in the longitudinal direction of switch casing 29 is only very slightly larger than the length of switch casing 29, whereas the extension of the wall portion 37 measured in the longitudinal direction of temperature sensor 28 is larger than the associated width of switch casing 29, which is immediately adjacent to the rim wall 38 belonging to temperature sensor 28. In rim wall 38 is provided a port 42 relatively closely adapted to the outer cross-section of temperature sensor 28 and through which the latter is passed immediately adjacent to switch casing 29 and on whose boundary temperature sensor 28 is supported in punctiform manner. A larger port 43 is provided in the facing rim wall 39 and in it is inserted in approximately clearance-free manner with a shank portion an insulator 44 which, on the inside of depression 36, has a head widened compared with port 43 and which can be positioned immediately adjacent to rim wall 39. Two leads 45 are so passed through the cross-sectionally, preferably flat-oval insulator 44, whose greater cross-sectional extension is parallel to wall portion 37, that their double bent section 46 exposed between insulator 44 and switch casing 29 is relatively short and namely in the longitudinal direction of temperature sensor 28 has an extension which is only slightly larger than the length of the connecting lugs 47 which, on the side of switch casing 29 remote from temperature sensor 28, project on either side adjacent to the narrow sides thereof and parallel thereto. The position of insulator 44 with respect to leads 45 is fixed by bent portions of leads 45 located immediately adjacent to its two ends, sections 46 being bent away from one another adjacent to insulator 44 and then bent again in the direction of switch casing 29. The portions of leads 45 located in cover 17 are connected to connecting pins at the ends of heating resistors 7, 8, which project downwards over insulating material 11 and are located adjacent to depression 36.

Switch casing 29 of thermal cutout 27 has a basic body receiving in completely flush manner the limiter switch 30 and flange plate 33 and which on its top is open for the insertion of all switch parts and the flange plate 33 and can be closed by a casing cover 49 resembling its horizontal projection. At the most, switch casing 29 extends up to the underside of cover 17 formed by flange rim 19 or only very slightly projects downwards over the same. The planar wall portion 37 engages only linearly in the vicinity of the terminal edges of spiral webs 10 or layer 12 and in the vicinity of spiral grooves 9 is contact-free with respect to insulating material 11, accompanied by the formation of laterally open channels.

The inventive or a similar construction is also advantageously suitable for coupling the temperature sensor 28 by additional measures in a particularly close or intense thermally conducting manner to the area to be measured. For example, under cover 17, temperature sensor 28 can be provided with a stainless steel or similar metal guide projecting over its outer shape and which surrounds the temperature sensor 28 closely and approximately over its entire length and which projects roughly parallel to the underside of hotplate body 2 over both sides of temperature sensor 28. This sheet-metal guide 50 can be longitudinally simply mounted on temperature sensor 28 through being provided with successive slots at right angles to sensor 28 and between adjacent slots portions are bent out in channel-like manner from the plane of guide 50 alternately to either side, so that an insertion opening for temperature sensor 28 closed over the circumference is formed in a longitudinal view of temperature sensor 28. The wings of the sheet-metal guide 50 projecting on either side over temperature sensor 28 can be located in a common plane or can be bent out of said plane in such a way that they are either closer to the underside 4 of hotplate body 2 or engage in large area manner thereon, or are further remote from the underside 4 adjacent to cover 7, as a function of how the heat conducting coupling is to be adjusted. The outer rim of guide 50 can also be designed in such a way that it immediately adjacently faces an opposite face of the remaining hotplate, e.g. the inner face of the outer ring flange 14, so that temperature sensor 28 is prevented from any lateral deflections by engaging on said opposite face.

In addition to at least one of the two power contacts switching the electric hotplate power, there can be provided a further auxiliary contact for or as a hot indication, so that the individual contacts can be made smaller as a result of reduced power exposure. This additional auxiliary contact closes with rising temperature. Apart from being suitable for so-called automatic hotplates, the inventive construction is also suitable for those electric hotplates, which have no automatic temperature sensor 21 in the centre, but in which the opening-free central zone 6 is occupied by other components, such as temperature switches, fixing members or the like.

I claim:

1. An electric hotplate (1) comprising:

a hotplate body (2) having a central zone (6) on an underside (4) remote from a cooking surface (3)

at least one heating resistor (7, 8) arranged about the central zone (6) and defining a heated area at least one thermal cutout (27) having a switch casing (29) arranged in the heated area and receiving a limiting switch (30), said thermal cutout having a temperature sensor (28) acting on the limiting switch, wherein the temperature sensor (28) of the thermal cutout (27) is constructed as an expansion rod sensor located outside of the switch casing (29) in an exposed manner and remote from the central zone (6), said temperature sensor being spaced from the underside (4) of the hotplate body (2) and arranged substantially parallel thereto.

2. An electric hotplate according to claim 1, wherein the underside (4) of the hotplate body (2) is at least partly provided with a cover (17) having an inside and an outside, the switch casing (29) being at least partly located on the outside and the temperature sensor (28) substantially on the inside of said cover (17).

3. An electric hotplate according to claim 2, wherein the switch casing (29) is located completely outside the cover (17).

4. An electric hotplate according to claim 2, wherein said cover (17) has a depression (36) receiving the switch casing (29), a planar base wall of said depression substantially engaging on the underside (4) of the hotplate body (2).

5. An electric hotplate according to claim 2, wherein electrical connecting leads (45) are provided on said thermal cutout (27), said leads (45) passing from the switch casing (29) through a port (43) on the inside of the cover (17) to the heating resistor (7, 8), an insulator (4) being inserted in the port (43), said leads being located in the insulator (44) made from a ceramic material.

6. An electric hotplate according to claim 2, wherein at least one port (42) is provided in said cover, said temperature sensor (28) being passed through one port (42) on the inside of cover (17), said port being located directly adjacent to the switch casing (29) receiving an inner end of said temperature sensor.

7. An electric hotplate according to claim 6, wherein at least one port (42, 43) is provided in an upright wall portion of the cover (17) respective the depression (36).

8. An electric hotplate according to claim 2, wherein the thermal cutout (27) is mounted by means of at least one plug-in mount exclusively on the cover (17).

9. An electric hotplate according to claim 1, wherein a substantially completely closed wall portion (37) is provided, said wall portion (37) being arranged between the switch casing (29) and the underside (4) of the hotplate body (2).

10. An electric hotplate according to claim 1, wherein the switch casing (29) is substantially supported against the underside (4) of the hotplate body (2).

11. An electric hotplate according to claim 1, wherein the switch casing (29) is substantially supported against an insulating material (11) embedding the heating resistor (7, 8).

12. An electric hotplate according to claim 1, wherein the thermal cutout (27) is mounted by means of at least one plug-in mount on the hotplate.

13. An electric hotplate according to claim 12, wherein two opposite plug-in mounts are provided, one being formed by the temperature sensor (28) engaging in a first port (42) and one being formed by the insulator (44) engaging in a second opposite port (43) of the cover (17).

14. An electric hotplate according to claim 1, wherein at least one section (46) of leads (45) each connected to a corresponding connecting lug (47) of the switch casing (29) is provided, said section (46) forming a resilient support arm for the thermal cutout (27), said section (46) being located between said connecting lug (47) and an insulator (44) and comprising a dimensionally stable solid cross-section wire.

15. An electric hotplate according to claim 1, wherein the temperature sensor (28) has a central axis (35) located substantially tangential to an imaginary circle around a central axis (15) of the hotplate body (2).

16. An electric hotplate according to claim 1, wherein an inner end of said temperature sensor is located substantially in the center of a width defined by the heated area (5), the switch casing (29) being located substantially in an axial plane (34) of the hotplate body (2) at right angles to the central axis (35) of the temperature sensor (28).

17. An electric hotplate according to claim 1, wherein said hotplate body (2) has an outer and an inner flange ring (14, 13) projecting from the underside, said switch casing (29) being arranged between the outer and the inner ring flange (14, 13)

18. An electric hotplate according to claim 7, wherein adjacent to the depression (36), the cover (17) is supported on at least one ring flange (13, 14) of the hotplate body (2).

19. An electric hotplate according to claim 1, wherein switch parts are provided in the switch casing having a cup-shaped casing body (48) providing an open side for an inserted fitting of the switch parts and temperature sensor (28).

20. An electric hotplate according to claim 19, wherein said casing body (48) is closed on said side with a casing lid (49).

21. An electric hotplate according to claim 19, wherein the casing body (48) faces with said open side the underside (4) of the hotplate body (2).

22. An electric hotplate according to claim 1, wherein on the hotplate body (2) is provided a further temperature sensor of a power control device (23).

23. An electric hotplate according to claim 22, wherein the further temperature sensor is provided in the vicinity of the underside of the hotplate body.

24. An electric hotplate according to claim 22, wherein the further temperature sensor (21) is located in an opening (20) in a center of the hotplate body (2), said temperature sensor (21) extending in the vicinity of cooking surface (3).

25. An electric hotplate according to claim 22, wherein the further temperature sensor is a hydraulic temperature sensor (21) connected via a capillary tube (22) to an expansion member (24) acting on a switch (25) of said power control device (23).

* * * * *